US009036785B2

(12) United States Patent
Saito et al.

(10) Patent No.: US 9,036,785 B2
(45) Date of Patent: May 19, 2015

(54) HIGH-VOLTAGE APPARATUS, AND RADIATION SOURCE AND RADIOSCOPIC APPARATUS HAVING THE SAME

(75) Inventors: Tasuku Saito, Kyoto (JP); Hideki Fujii, Koga (JP)

(73) Assignee: SHIMADZU CORPORATION, Kyoto (JP)

( * ) Notice: Subject to any disclaimer, the term of this patent is extended or adjusted under 35 U.S.C. 154(b) by 775 days.

(21) Appl. No.: 13/265,539

(22) PCT Filed: Apr. 22, 2009

(86) PCT No.: PCT/JP2009/001836

§ 371 (c)(1),
(2), (4) Date: Oct. 20, 2011

(87) PCT Pub. No.: WO2010/122602

PCT Pub. Date: Oct. 28, 2010

(65) Prior Publication Data

US 2012/0039442 A1 Feb. 16, 2012

(51) Int. Cl.

| | |
|---|---|
| ***H05G 1/32*** | (2006.01) |
| ***H05G 1/10*** | (2006.01) |
| ***H01J 35/26*** | (2006.01) |
| ***H05G 1/38*** | (2006.01) |
| ***H05G 1/46*** | (2006.01) |

(52) U.S. Cl.
CPC *H05G 1/10* (2013.01); *H01J 35/26* (2013.01); *H05G 1/32* (2013.01); *H05G 1/38* (2013.01); *H05G 1/46* (2013.01)

(58) Field of Classification Search
CPC ..... H01J 35/26; H05G 1/10; H05G 1/32; H05G 1/38; H05G 1/46
USPC ..... 378/101, 109–112, 117, 118, 144
See application file for complete search history.

(56) References Cited

U.S. PATENT DOCUMENTS 4,985,908 A * 1/1991 Asahina ..... 378/98.3
2005/0163285 A1 7/2005 Kudo

FOREIGN PATENT DOCUMENTS

CN 1627470 A 6/2005
JP 36-5128 B1 5/1961

(Continued)

OTHER PUBLICATIONS

International Search Report for the Application No. PCT/JP2009/001836 mailed May 26, 2009.

(Continued)

*Primary Examiner* — Toan Ton
*Assistant Examiner* — Mona M Sanei
(74) *Attorney, Agent, or Firm* — Cheng Law Group, PLLC

(57) ABSTRACT

In a high-voltage apparatus according to this invention, a predetermined voltage is applied to a rotating anode after waiting until the number of rotations increases to such an extent that the rotating anode is not damaged. That is, X-rays of desired intensity are already outputted from a point of time when the voltage is applied to the rotating anode. Therefore, diagnosis can be performed immediately after the voltage is applied to the rotating anode. That is, unlike the prior art, there is no need to wait until X-ray intensity becomes suitable for diagnosis after X-ray emission is started, and there is no need to irradiate the patient with unnecessary X-rays. Therefore, the patient can be inhibited from being irradiated with excessive X-rays (with an improvement made in a response from when the operator gives instructions for starting fluoroscopy until emission of X-rays suitable for diagnosis).

8 Claims, 8 Drawing Sheets

(56) References Cited

FOREIGN PATENT DOCUMENTS

| | | | |
|---|---|---|---|
| JP | 64-38800 | U | 3/1989 |
| JP | 9-213494 | A | 8/1997 |

OTHER PUBLICATIONS

The First Office Action for the Application No. 200980158893.X from The State Intellectual Property Office of the People's Republic of China dated Nov. 5, 2013.

* cited by examiner (a)

(b)

HIGH-VOLTAGE APPARATUS, AND RADIATION SOURCE AND RADIOSCOPIC APPARATUS HAVING THE SAME

TECHNICAL FIELD

This invention relates to a high-voltage apparatus for supplying power to a radiation source for which radiation intensity is variable, and a radiation source and a radioscopic apparatus having the same.

BACKGROUND ART

A medical institution has a radioscopic apparatus installed therein for acquiring fluoroscopic images of patients. A conventional construction of such a radioscopic apparatus will be described. A conventional radioscopic apparatus includes a top board for supporting a patient, a radiation source disposed above the top board, and a radiation detecting device (FPD) disposed below the top board. The radiation source and FPD are movable along the body axis of the patient M.

The construction of a radiation source 53 will be described specifically. As shown in FIG. 7, the radiation source 53 has a disk-shaped rotating anode 61 with a tapered edge. The rotating anode 61 is located in a hollow portion of a vacuum chamber 62 where a vacuum is maintained. A support shaft 63 rotatably supports the rotating anode 61. A cathode 64 is installed in a position opposed to the edge of the rotating anode 61, from which electrons E are emitted to an edge region of the rotating anode 61. At this time, a high voltage is applied between the rotating anode 61 and cathode 64. The electrons E discharged from the cathode 64 impinge on the edge region of the rotating anode 61, from which an X-ray beam B is emitted outward of the vacuum chamber 62. A radiation source of such construction is described in Patent Document 1, for example.

The voltage applied between the rotating anode 61 and cathode 64 is supplied from a voltage applying unit 67. And a rotating mechanism 65 which rotates the support shaft 63 is provided in order to rotate the rotating anode 61 relative to the cathode 64.

An input unit 80 inputs instructions of the operator, through which the operator can freely control the radiation source 53. A main controller 81 carries out overall control of the components of an X-ray tube.

Operation of such radiation source 53 will be described. As shown in FIG. 8, at the beginning when an emission of radiation is stopped, voltage V between the two electrodes 61 and 64 is 0.

When the operator instructs an emission of radiation through the input unit 80, rotation of the rotating anode 61 is started at this point of time TA, and the number of rotations R of the rotating anode 61 which was 0 at the beginning increases. At the same time, the voltage applying unit 67 first applies between the two electrodes 61 and 64 a minimum voltage VL so low as to cause no damage to the rotating anode 61 even if the latter remains still.

When rotation of the rotating anode 61 is started, the rotating anode 61 will be brought to a predetermined number of rotations RA in due time. However, at the point of time TA the rotating anode stands still, and it takes some time to reach the predetermined number of rotations RA. This time required is set to t1.

If the high voltage is applied between the two electrodes 61 and 64 before the rotating speed of the rotating anode 61 is enough, electron-incident portions of the edge region of the rotating anode 61 will be heated to excess, and thus a possibility of damaging the rotating anode 61. In order to prevent this, according to the conventional construction, when fluoroscopy is started from the state of the rotating anode standing still, the minimum voltage VL (e.g. 50 kV) is first applied to the two electrodes 61 and 64 at the point of time TA. And at the same time as the speed of the rotating anode 61 increases, the voltage applied to the two electrodes 61 and 64 is gradually increased. Finally, the voltage applied to the two electrodes 61 and 64 will become voltage VA (e.g. 80 kV) suitable for diagnosis. The period from when the voltage VL is applied to the two electrodes 61 and 64 until the voltage VA suitable for diagnosis is reached is set to E. An ABC (automatic brightness controller) 70 carries out this voltage control, which adjusts brightness of fluoroscopic images by changing radiation intensity automatically.

Thus, according to the conventional construction, when fluoroscopy is started at the point of time TA for starting an emission of radiation from the state of the rotating anode standing still, the minimum voltage VL is constantly applied to the two electrodes 61 and 64.

[Patent Document 1] Unexamined Patent Publication H9-213494

DISCLOSURE OF THE INVENTION

Problem to be Solved by the Invention

However, the radiation source of conventional construction has the following problem.

With the radiation source of conventional construction, in the case of starting fluoroscopy from the state of the rotating anode standing still, when an emission of radiation is started, the voltage applied to the two electrodes 61 and 64 is first started from the minimum voltage VL, and is raised to the voltage VA suitable for diagnosis. It is from the time the voltage VA suitable for diagnosis is applied to the two electrodes 61 and 64 that the intensity of radiation becomes what is desired by the operator. That is, the intensity of the radiation emitted from the radiation source is weak until the voltage applied to the two electrodes 61 and 64 becomes the voltage VA suitable for diagnosis. That is, the radiation emitted at voltages lower than the voltage VA suitable for diagnosis cannot be used for diagnosis. It is necessary after all to wait until the voltage applied to the two electrodes 61 and 64 becomes the voltage VA suitable for diagnosis.

Fluoroscopic images suitable for diagnosis are available only after reaching a period P in FIG. 8. That is, during the period E in FIG. 8, unnecessary radiation proceeds to the patient M. From the viewpoint of inhibiting exposure of the patient M to dosage, it is desirable to provide a construction which emits radiation from the radiation source only when fluoroscopic images suitable for diagnosis are obtained. The unnecessary exposure during the period E should be inhibited.

This invention has been made having regard to the state of the art noted above, and its object is to provide a high-voltage apparatus which can inhibit exposure to radiation of patients, and a radiation source and a radioscopic apparatus having the same.

Means for Solving the Problem

To fulfill the above object, this invention provides the following construction.

A high-voltage apparatus according to claim 1 is a high-voltage apparatus for supplying voltage to a radiation source having a rotating anode, a chamber enclosing the rotating anode, a rotating device for rotating the rotating anode, and a rotation control device for controlling the rotating anode, the apparatus comprising a voltage applying device for applying the voltage to the rotating anode; and a voltage application instructing device for instructing the voltage applying device to apply a predetermined voltage for radioscopy from a time when the rotating anode reaches a high number of rotations to an extent of being free from damage.

[Functions and effects] In the high-voltage apparatus according to this invention, a predetermined voltage is applied to the rotating anode after waiting until the number of rotations increases to such an extent that the rotating anode is not damaged. That is, even when fluoroscopy is started in a state of the rotating anode standing still, radiation of an intensity desired by the operator is already outputted from a point of time when the voltage is applied to the rotating anode. Therefore, fluoroscopic images suitable for diagnosis are acquirable immediately after the voltage is applied to the rotating anode. That is, unlike the prior art, there is no need to wait until radiation intensity becomes an intensity suitable for diagnosis after radiation emission is started, and there is no need to irradiate the patient with radiation which cannot be used for diagnosis. Therefore, the patient can be inhibited from being irradiated with unnecessary radiation.

One aspect of the present invention is the high-voltage apparatus, wherein the voltage application instructing device instructs application of the voltage at a point of time when the rotating anode reaches the high number of rotations to the extent of being free from damage by the application of the voltage; and the voltage application instructing device, based on a current and the voltage applied to the rotating anode, determines a period from a start of the rotation of the rotating anode until the rotating anode reaches the high number of rotations to the extent of being free from damage by the application of the voltage.

Another aspect of the present invention is the high-voltage apparatus, wherein the voltage application instructing device instructs application of the voltage at a point of time of a lapsed delay time indicating a period between a point of time when the application of the voltage to the rotating anode is ended and the rotating anode reaches the high number of rotations to the extent of being free from damage by the application of the voltage; and the voltage application instructing device determines the delay time, based on a current and the voltage applied to the rotating anode, and a lag time between when the application of the voltage to the rotating anode is ended and braking of the rotation of the rotating anode is started.

[Functions and effects] The above constructions are specific examples of how the voltage application instructing device determines that the number of rotations of the rotating anode has fully increased. That is, the voltage application instructing device determines that the rotating anode has reached the number of rotations causing no damage when a certain period has elapsed from a start of rotation of the rotating anode in a stopped state. The voltage application instructing device determines that the rotating anode has reached the number of rotations causing no damage also when the delay time elapses from the point of time when the application of the voltage to the rotating anode is ended. With such constructions, the voltage is applied at a point of time when the number of rotations of the rotating anode has fully increased. Therefore, the rotating anode will never be damaged even if the predetermined voltage is applied between the rotating anode and a cathode. This delay time may be varied according to loads applied.

Another aspect of the present invention is the high-voltage apparatus, further comprising a number of rotations measuring device for measuring the number of rotations of the rotating anode; wherein the voltage application instructing device instructs application of the voltage at a point of time when the number of rotations measured reaches the high number of rotations to the extent of the rotating anode being free from damage by the application of the voltage.

[Functions and effects] The above construction is a specific example of how the voltage application instructing device determines that the number of rotations of the rotating anode has fully increased. That is, the voltage application instructing device determines that the number of rotations causing no damage to the rotating anode has been reached when the number of rotations of the rotating anode actually measured by the number of rotations measuring device reaches or exceeds a predetermined number of rotations. The number of rotations of the rotating anode can be said to have fully increased if the number of rotations has reached or exceeded the predetermined number of rotations (allowable number of rotations). Therefore, the rotating anode will never be damaged even if the predetermined voltage is applied between the rotating anode and the cathode. This allowable number of rotations may be varied according to loads applied.

Another aspect of the present invention is the high-voltage apparatus, further comprising an input device for inputting instructions of an operator; wherein the voltage application instructing device instructs application of the voltage after instructions are given by the operator to end a previous application of the voltage to the rotating anode, and under a state where the high number of rotations to the extent of the rotating anode being free from damage.

[Functions and effects] The above construction is a specific example of how the voltage application instructing device determines that the number of rotations of the rotating anode has fully increased. Upon lapse of a certain period of time after an end of radiation emission, the rotating anode will be braked to slow down, and the rotating anode will stop completely in several minutes. However, the rotation of the rotating anode will not stop yet for a certain period of time after the braking. When the number of rotations of the rotating anode is maintained high enough, the voltage can be applied between the rotating anode and the cathode immediately without waiting for the delay time from the start of rotation. In the above construction, the number of rotations of the rotating anode is high enough to cause no damage when the time from a point of time a previous application of the voltage to the rotating anode is terminated until a point of time instructions for starting emission of radiation are inputted to the input device is shorter than a predetermined allowed time. In this case, therefore, the voltage application instructing device in the above construction determines that the number of rotations causing no damage to the rotating anode has been reached even before lapse of the delay time from the start of rotation of the rotating anode. This improves the response of the radiation source to an input made by the operator. This allowed time may be varied according to loads applied.

Another aspect of the present invention is the high-voltage apparatus, further comprising a set value storage device for storing a set value to be referred to by the voltage application instructing device; wherein the set value is changeable.

[Functions and effects] According to the above construction, the radiation source can be provided which can cope, with increased freedom, with changes made in the method of examination, for example. That is, since the operator can change the set voltage value at will, it is certain that the voltage applied between the rotating anode and the cathode is, from a point of time of application, what is desired by the operator.

Another seventh aspect of the present invention is a radiation source equipped with the high-voltage apparatus, comprising a rotating anode; a chamber enclosing the rotating anode; a rotating device for rotating the rotating anode; and a rotation control device for controlling the rotating anode.

[Functions and effects] According to the above construction, the radiation source provided can output radiation of desired intensity from a start of emission.

Another aspect of the present invention is a radioscopic apparatus having the radiation source, comprising a radiation detecting device for detecting radiation emitted from the radiation source.

[Functions and effects] According to the above construction, the radioscopic apparatus provided has the radiation source that can output radiation of desired intensity from a start of emission. The patient is not exposed to radiation that cannot be used for diagnosis. Therefore, the radioscopic apparatus provided inhibits exposure to radiation of the patient.

DESCRIPTION OF REFERENCES

1 rotating anode
2 vacuum chamber (chamber)
3 support shaft
4 cathode
5 rotating mechanism (rotating device)
6 rotation control unit (rotation control device)
7 voltage applying unit (voltage applying device)
8 voltage application instructing unit (voltage application instructing device)
9 number of rotations measuring unit (number of rotations measuring device)
10 X-ray tube (radiation source)
22 set value storage unit (set value storage device)
34 FPD (radiation detecting device)

BEST MODE FOR CARRYING OUT THE INVENTION

The best mode of a radiation source and a radioscopic apparatus according to this disclosure will be described hereinafter with reference to the drawings. The X-rays in the following description are an example of the radiation in this disclosure.

Embodiment 1

Figure 1:
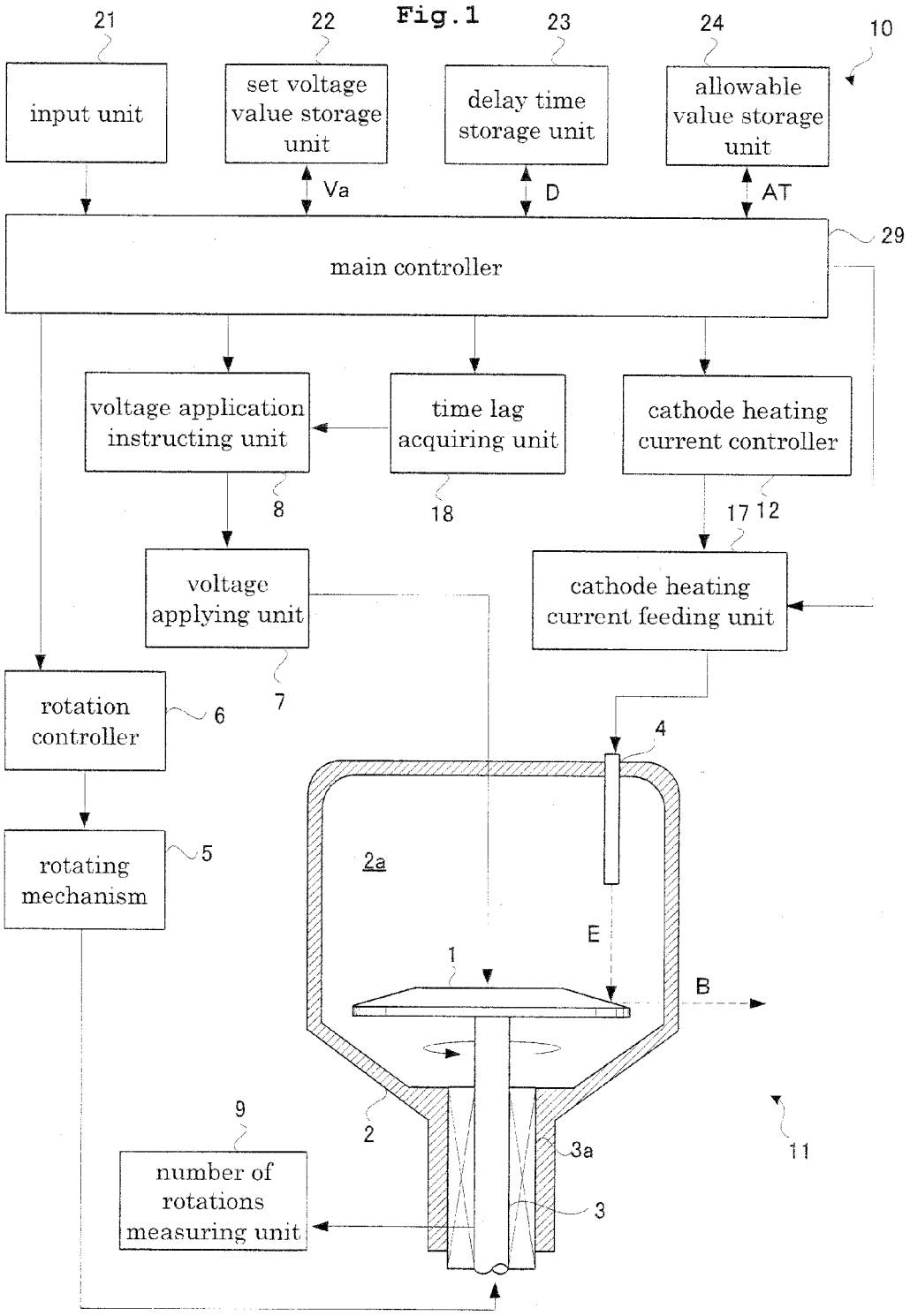
FIG. 1 is a functional block diagram illustrating a construction of an X-ray tube according to Embodiment 1.
Figure 2:
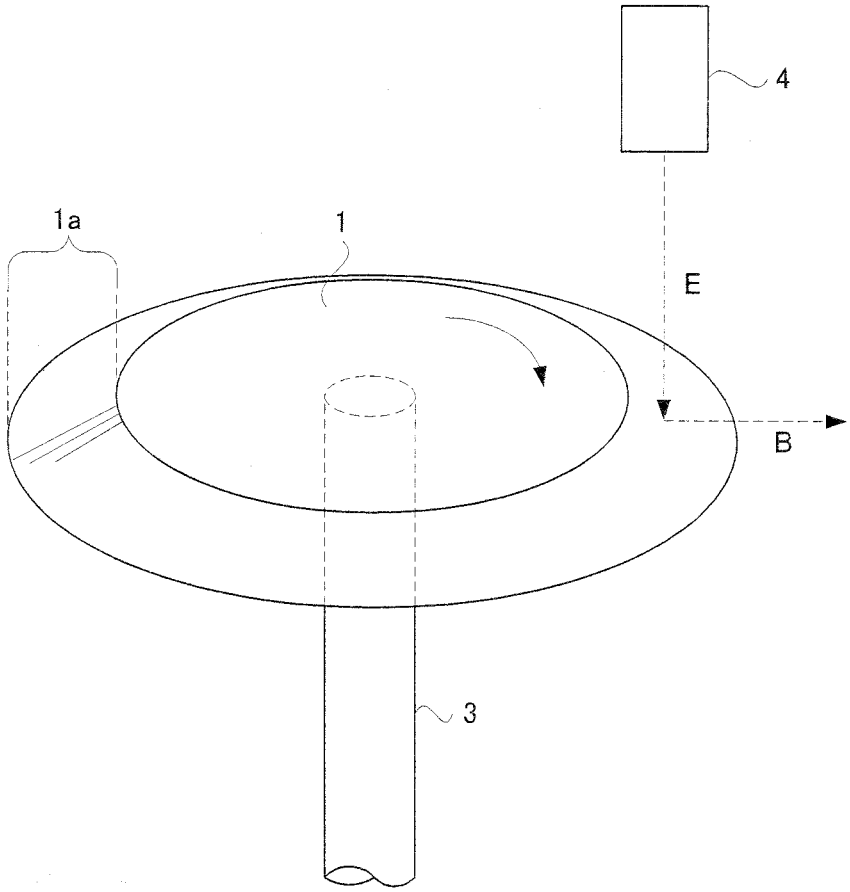
FIG. 2 is a perspective view illustrating a construction of a rotating anode according to Embodiment 1.

The construction of an X-ray tube 10 according to this disclosure will be described. The X-ray tube 10 has a rotating anode 1 as shown in FIG. 1. The rotating anode 1 is located in a hollow portion 2*a* of a vacuum chamber 2 where a vacuum is maintained. FIG. 2 is a perspective view illustrating a construction of a rotating anode according to Embodiment 1. The rotating anode 1 is rotatably supported by a support shaft 3. This rotating anode 1 is disk-shaped, and is tapered to become thinner along directions away from the support shaft 3. That is, the rotating anode 1 is shaped like an umbrella, and has an edge region 1*a* (see FIG. 2) inclined relative to the support shaft 3. The edge region 1*a* is also called the target of an electron beam. The vacuum chamber corresponds to the chamber in this disclosure. The X-ray tube corresponds to the radiation source in this disclosure.

A forward end of a cathode 4 is located in the hollow portion 2*a* of the vacuum chamber 2, and is opposed to the edge region 1*a* of the rotating anode 1. When voltage is applied to the rotating anode 1 and cathode 4, electrons E will be emitted from the forward end of this cathode 4 toward the edge region 1*a* of the rotating anode 1. The electrons E discharged from the cathode 4 impinge on the edge region 1*a* of the rotating anode 1, from which an X-ray beam B is emitted outward of the vacuum chamber 2. The forward end of the cathode 4 is formed as a filament for releasing electrons.

The rotating anode 1, vacuum chamber 2, support shaft 3 and cathode 4 are collectively called a vessel 11.

A high voltage applied to the rotating anode 1 and cathode 4 is supplied from a voltage applying unit 7. The voltage supplied from the voltage applying unit 7 is variable. A voltage application instructing unit 8 outputs instruction signals to the voltage applying unit 7. The voltage applying unit 7 stops application of the voltage between the rotating anode 1 and cathode 4, and resumes application of the voltage in response to the instruction signals. The voltage applying unit corresponds to the voltage applying device in this disclosure. The voltage application instructing unit corresponds to the voltage application instructing device of this disclosure.

A cathode heating current feeding unit 17 supplies a current of low voltage to the cathode 4. This current passes through the cathode 4 in a coil form, and heats the cathode 4. That is, in the X-ray tube 10, the cathode 4 is heated before generating X-rays. The heated cathode 4 tends to emit thermoelectrons, and when a high voltage is applied from the voltage applying unit 7 to the two electrodes 1 and 4 in this state, electrons E will fly out of the cathode 4 one after another toward the rotating anode 1. This cathode heating current feeding unit 17 is controlled by a cathode heating current controller 12.

A rotating mechanism 5 which rotates the support shaft 3 is provided in order to rotate the rotating anode 1 relative to the cathode 4. The rotating mechanism 5 is controlled by a rotation controller 6. An input unit 21 inputs instructions of the operator, and through this the operator can instruct a start of fluoroscopy and change X-ray conditions. An insulating ring 3*a* is a bearing of the support shaft 3. This insulating ring 3*a* insulates the support shaft 3 and vacuum chamber 2, and prevents air flowing from outside the vacuum chamber 2 toward the hollow portion 2*a* maintained under vacuum. The rotation controller corresponds to the rotation control device in this disclosure. The rotating mechanism corresponds to the rotating device in this disclosure.

A number of rotations measuring unit 9 monitors the number of rotations of the rotating anode 1 from time to time. The number of rotations measuring unit 9 outputs number of rotations data to a main controller 29 to be described hereinafter. The number of rotations measuring unit corresponds to the number of rotations measuring device in this disclosure.

Each of a set voltage value storage unit 22, a delay time storage unit 23 and an allowable value storage unit 24 is a storage unit for storing each of a set voltage value Va, a delay time D and an allowed time AT to be described hereinafter. The X-ray tube 10 includes also a time lag acquiring unit 18. The meaning of providing these will be described hereinafter. The operator can update through the input unit 21 the set voltage Va stored in the set voltage value storage unit 22.

The X-ray tube 10 includes the main controller 29 for carrying out overall control of each of the rotation controller 6, voltage application instructing unit 8 and cathode heating current controller 12. The main controller 29 is constructed of a CPU and realizes the components by executing various programs. The above components may be realized as divided into arithmetic units in charge thereof.

Figure 3:
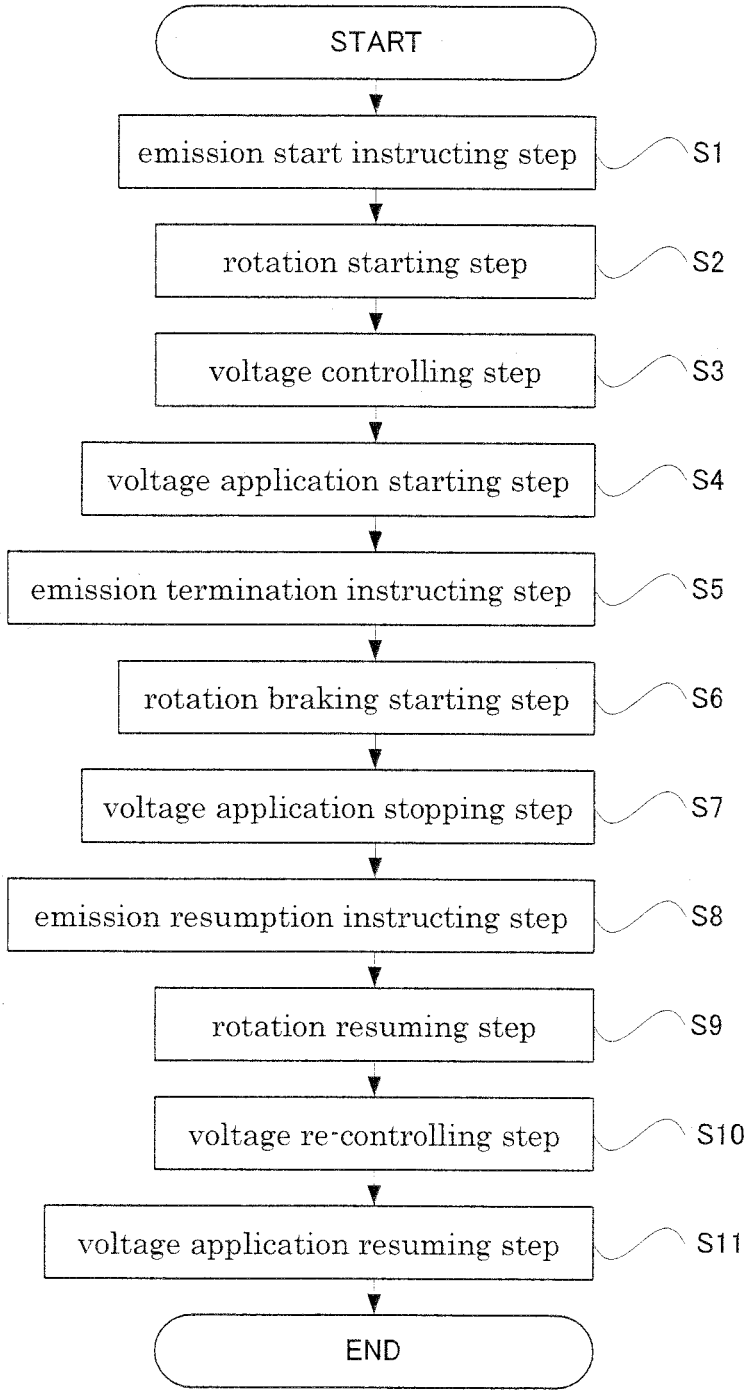
FIG. 3 is a flow chart illustrating operation of the X-ray tube according to Embodiment 1.

Next, operation of the X-ray tube 10 according to Embodiment 1 will be described. FIG. 3 is a flow chart illustrating operation of the X-ray tube according to Embodiment 1. A series of operations incorporating characteristics of the operation of the X-ray tube 10 according to Embodiment 1 is shown. That is, an example of operation of the X-ray tube 10 described hereunder includes an emission start instructing step S1 for inputting instructions for an emission start to the input unit 21, a rotation starting step S2 for starting rotation of the rotating anode 1, a voltage control step S3 for controlling the voltage of the voltage applying unit 7, a voltage application starting step S4 for starting application of the voltage, an emission termination instructing step S5 for inputting instructions to the input unit 21 for terminating the emission, a rotation braking starting step S6 for starting to brake the rotation of the rotating anode 1, a voltage application stopping step S7 for stopping the application of the voltage, an emission resumption instructing step S8 for inputting instructions to the input unit 21 for resuming the emission, a rotation resuming step S9 for resuming the rotation of the rotating anode 1, a voltage re-control step S10 for controlling the voltage of the voltage applying unit 7, and a voltage application resuming step S11 for resuming the application of the voltage. Details of each of these steps will be described in order hereinafter.

<Emission Start Instructing Step S1, Rotation Starting Step S2>

First, the operator instructs the X-ray tube 10 through the input unit 21 to emit X-rays. Then, the rotation controller 6 immediately instructs a start of rotation of the rotating anode 1, thereby starting rotation of the rotating anode 1 having been stopped rotating.

<Voltage Controlling Step S3>

Subsequently, the voltage of the voltage applying unit 7 is adjusted by the voltage controller 8. That is, the voltage controller 8 reads the set voltage value Va stored in the set voltage value storage unit 22, and sets the voltage of the voltage applying unit 7 to Va. Since the voltage application instructing unit 8 has at this point of time not instructed the voltage applying unit 7 to apply the voltage, application of the voltage to the two electrodes 1 and 4 by the voltage applying unit 7 remains suspended.

In the emission start instructing step S1, the operator may instruct a change of the set voltage value Va before instructing an X-ray emission. At this time, after a new set voltage value Vb acquired at the input unit 21 is stored in the set voltage value storage unit 22, the voltage controller 8 will control the voltage applying unit 7 based on this new set voltage value Vb. At the time of the emission start instructing step S1, the cathode heating current feeding unit 17 is controlled by the cathode heating current controller 12 to start heating the cathode 4.

<Voltage Application Starting Step S4>

Figure 4:
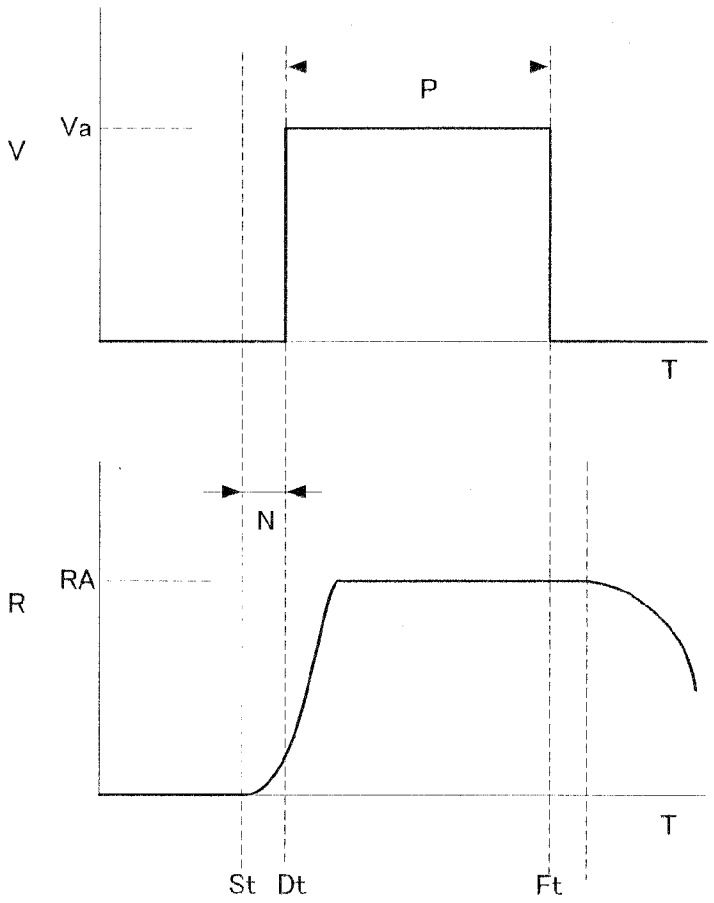
FIG. 4 is a timing chart illustrating operation of the X-ray tube according to Embodiment 1.
Figure 4:
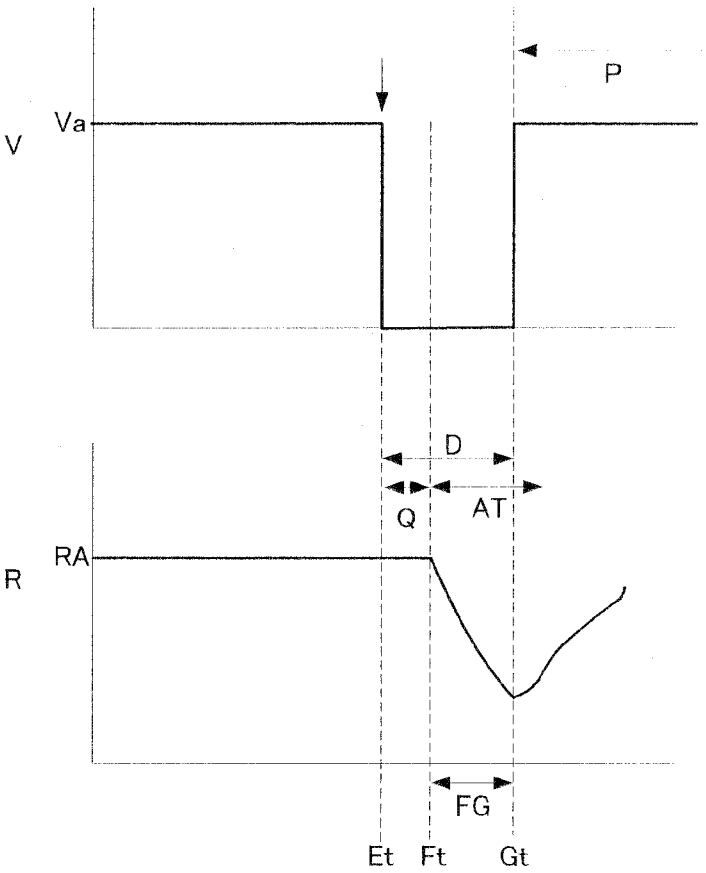

Next, the voltage application instructing unit 8 reads a period N stored in the delay time storage unit 23. This period N is 0.5 second, for example. Alternatively, a value calculated by the main controller 29 as a function of the load of the set voltage value Va or Vb may be used as the period N. A method of calculating this period N will be described hereinafter. As shown in FIG. 4(*a*), the voltage application instructing unit 8 gives instructions to the voltage applying unit 7 for starting voltage application after elapse of a certain period N from a point of time St when an X-ray emission is instructed. In this way, the set voltage Va is applied to the two electrodes 1 and 4, and X-rays are released from the X-ray tube 10. Thus, the voltage application instructing unit 8 has a construction for instructing application of the voltage based on the period N. The period N indicates a period from a start of rotation of the rotating anode 1 having been stopped rotating until attainment of a high number of rotations to an extent of causing no damage to the rotating anode 1 even if the voltage is applied thereto.

The voltage application starting step S4 will be described in greater detail with reference to FIG. 4(*a*). At the point of time St when the X-ray emission is instructed, rotation of the rotating anode 1 is started immediately. However, at the point of time St the rotation of the rotating anode 1 is not sufficiently high, and if a high voltage were applied to the two electrodes 1 and 4 from this point of time, the rotating anode 1 could be damaged. So, according to the construction in Embodiment 1, a high voltage is applied to the two electrodes 1 and 4 at a point of time Dt when the period N has passed from the point of time St. Since the number of rotations has fully increased by the point of time Dt, the rotating anode 1 is never damaged.

According to the conventional construction, X-ray intensity is weak at the time X-ray emission is started. According to the construction in Embodiment 1, X-ray intensity is what is desired by the operator at the time Dt of starting X-ray emission. This is because the set voltage Va is applied to the two electrodes 1 and 4 at the time Dt. That is, a period P when X-rays of intensity suitable for diagnosis are emitted is started at the point of time Dt in FIG. 4(*a*). That is, diagnosis can be started as soon as the X-ray emission is started.

<Emission Termination Instructing Step S5, Rotation Braking Starting Step S6, Voltage Application Stopping Step S7>

When the operator instructs termination of the X-ray emission through the input unit 21 [see a point of time Et in FIG. 4(*a*)], the voltage application instructing unit 8 gives instructions to the voltage applying unit 7 to stop application of the voltage, whereby the emission of X-rays is stopped. Subsequently, upon lapse of a certain period of time (e.g. 60 seconds) [see a point of time Ft in FIG. 4(*a*)], the rotation controller 6 controls the rotating mechanism 5 to carry out braking to slow down the rotation of the rotating anode 1. The rotating anode 1 continues rotating after the braking, slows down naturally, and comes to a stop soon. The voltage in the voltage applying unit 7 still is Va at this point of time.

<Emission Resumption Instructing Step S8, Rotation Resuming Step S9, Voltage Application Resuming Step S11>

Next, assume that a necessity to emit X-rays again arose after the end of the X-ray emission. The operator instructs resumption of the X-ray emission through the input unit 21. Then, the rotation controller 6 controls the rotating mechanism 5 to rotate the rotating anode 1 again. That is, as shown in FIG. 4(*b*), acceleration of rotation of the rotating anode 1 is started at a point of time Gt when resumption of the X-ray emission is instructed. An arrow in FIG. 4(*b*) indicates the point of time at which the operator gave the instructions to terminate the X-ray emission (the point of time of step S5). The emission of X-rays is stopped immediately after termination of the X-ray emission is instructed, in order to inhibit radiation exposure of the patient as much as possible. On the other hand, the rotation of the rotating anode 1 is given leeway, such that the rotation is braked upon lapse of a predetermined lag time Q after the emission of X-rays is stopped. The point of time of the rotating anode 1 beginning to be braked is set to the point of time Ft.

The intervening time from the point of time Ft to the point of time Gt (hereinafter called the inter-instruction time FG) is calculated by the time lag acquiring unit 18. And the voltage application instructing unit 8 reads the allowed time AT stored in the allowable value storage unit 24, and compares the inter-instruction time FG and the allowed time AT. And as shown in FIG. 4(*b*), when the voltage application instructing unit 8 finds the inter-instruction time FG shorter than the allowed time AT, the voltage application instructing unit 8 instructs voltage application. Thus, X-rays are re-emitted immediately at the point of time when resumption of the X-ray emission is instructed. The allowed time AT is five minutes, for example. Thus, the voltage application instructing unit 8 is constructed to instruct application of the voltage based on the allowed time AT. The time from the end of the X-ray emission until the X-ray emission is resumed is the delay time D. When the inter-instruction time FG is shorter than the allowed time AT as in FIG. 4(*b*), the delay time D becomes shorter than a sum of the lag time Q and allowed time AT.

The allowed time AT will be described. The allowed time AT is as follows. When the time from the point of time when the previous application of the voltage to the rotating anode 1 is terminated to the point of time when the instructions to start emission of the radiation are inputted to the input device is shorter than this allowed time AT, the rotating anode 1 is in the state of maintaining the high number of rotations to the extent of being free from damage even if the voltage is applied thereto.

When the inter-instruction time FG is smaller than the allowed time AT, the rotating speed of the rotating anode 1 is fast enough, and the rotating anode 1 is never damaged even if a high voltage is applied to the two electrodes 1 and 4. Moreover, since the voltage of the voltage applying unit 7 is Va, the voltage Va is applied to the two electrodes 1 and 4 at the point of time Gt when the operator instructs resumption of the X-ray emission. That is, the period P for emitting X-rays of the intensity suitable for diagnosis is resumed at the point of time Gt. This means that the operator can obtain X-ray fluoroscopic images suitable for diagnosis as soon as the X-ray emission is resumed.

Figure 5:
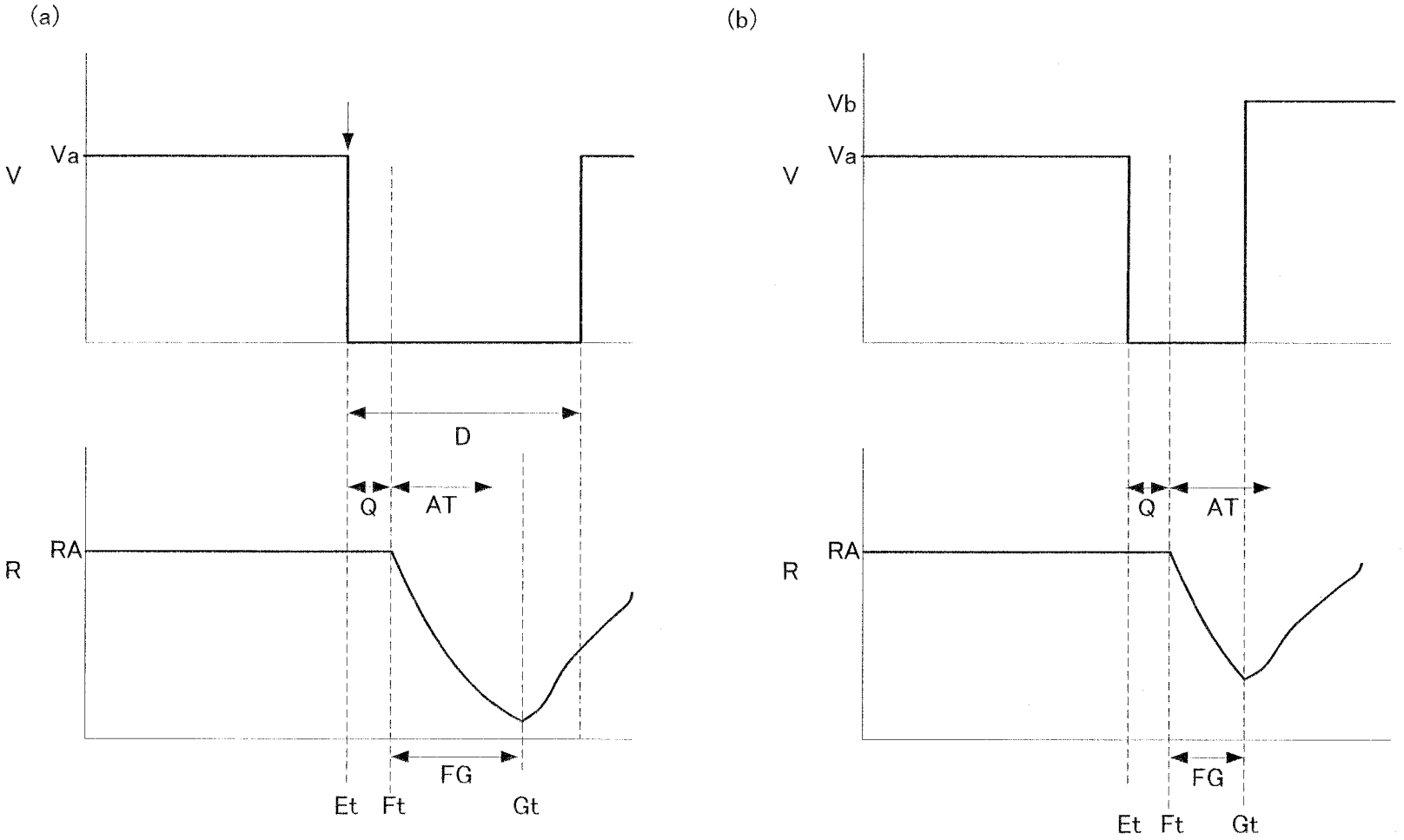
FIG. 5 is a timing chart illustrating operation of the X-ray tube according to Embodiment 1.

Next, a case where the inter-instruction time FG is equal to or longer than the allowed time AT will be described. When the inter-instruction time FG is equal to or longer than the allowed time AT, the rotating speed of rotating anode 1 is slow, and if the high voltage were applied to the two electrodes 1 and 4 without modification, the rotating anode 1 could be damaged. Therefore, when the inter-instruction time FG is equal to or longer than the allowed time AT, the voltage application instructing unit 8 does not permit immediate application of the high voltage to the two electrodes 1 and 4. As shown in FIG. 5(*a*), the voltage application instructing unit 8 instructs voltage application after lapse of the delay time D from the point of time Et when the X-ray emission is terminated. With the delay time D having passed after the point of time Gt, even if the high voltage is applied to the two electrodes 1 and 4, the rotating anode 1 is never damaged since the rotating speed of the rotating anode 1 has fully increased. The time from the end of the X-ray emission until the X-ray emission is resumed is the delay time D. When the inter-instruction time FG is equal to or longer than the allowed time AT as in FIG. 5(*a*), the delay time D becomes equal to or longer than the sum of the lag time Q and allowed time AT.

That is, whatever value the inter-instruction time FG has, the rotating speed of the rotating anode 1 has fully increased by the time X-rays are re-emitted, and the rotating anode 1 is never damaged. Moreover, the voltage Va is applied to the two electrodes 1 and 4 from the point of time X-rays are re-emitted. Therefore, the operator can obtain X-ray fluoroscopic images suitable for diagnosis as soon as the X-ray emission is resumed.

<Voltage Re-Controlling Step S10>

When re-emitting X-rays, the set voltage value Va can be changed. That is, assuming that the operator instructs through the input unit 21 a change of the set voltage value from Va to Vb before instructing resumption of the X-ray emission, as shown in FIG. 5(*b*), the X-ray emission is resumed by applying the voltage Vb to the two electrodes 1 and 4. Such operation is carried out by the voltage applying unit 7 reading the set value of voltage from the set voltage value storage unit 22 before the voltage application instructing unit 8 gives instructions to the voltage applying unit 7 to resume application of the voltage. In this way, the voltage applied to the two electrodes 1 and 4 in the previous X-ray emission can be changed freely whenever the X-ray emission is resumed. In this case also, the X-ray emission can be started with the set voltage value Vb by setting a proper delay time D.

Finally, a method of calculating the period N, and the delay time D when the inter-instruction time FG is equal to or longer than the allowed time AT, will be described by way of example. First, a damage limit load (maximum load under which damage begins to take place) in a state of the rotating anode 1 standing still is 2 kW. And a damage limit load when the rotating anode 1 is rotated at 60 Hz is 20 kW.

Since the damage limit load is proportional to the square root of the number of rotations of the rotating anode 1, a relation $(60)^{1/2}/(20-2)=r^{1/2}/(a-2)$ is formed, where a (kW) is a load applied to the rotating anode 1, and r is the highest number of rotations at which the rotating anode begins to be damaged at this time. When this is solved for r, the result is as follows:

$$r=60\cdot(a-2)^2/18^2$$

In this way, the highest number of rotations r at which the rotating anode begins to be damaged is determined. For example, when a=8 kW, r=about 7 Hz. When a load of 8 kW is applied to the rotating anode 1 in the state of the number of rotations of the rotating anode 1 being lower than this, the rotating anode 1 may be destroyed.

Since the rotating anode 1 increases by increments of 20 Hz per second from a stopped state, it takes about 0.3 second for the number of rotations of the rotating anode 1 to increase from a start of rotation to the number of rotations r. This is regarded as about 0.4 second by taking a safety factor 1.3 into account. That is, when the load on the rotating anode 1 is 8 kW, the period N is about 0.4 second. Where a rate of increase in the number of rotations of the rotating anode 1 is v (Hz/sec), the period N and delay time D are generally obtained as follows:

$$N>r/v$$

$$D>r/v+Q$$

Q is the lag time noted hereinbefore. The voltage application instructing unit 8 carries out calculations of the period N and delay time D. Therefore, data concerning the tube voltage and tube current and data concerning the time when each operation is carried out are successively transmitted to the voltage application instructing unit 8.

In the high-voltage apparatus according to Embodiment 1, as described above, a predetermined voltage is applied to the two electrodes 1 and 4 after waiting until the number of rotations increases to such an extent that the rotating anode 1 is not damaged. That is, X-rays of desired intensity are already outputted from a point of time when the voltage is applied to the two electrodes 1 and 4. Therefore, X-ray fluoroscopic images are acquirable immediately after the voltage is applied to the two electrodes 1 and 4. That is, unlike the prior art, there is no need to wait until X-ray intensity becomes an intensity suitable for diagnosis after X-ray emission is started, and there is no need to irradiate the patient M with X-rays which cannot be used for diagnosis. Therefore, the patient M can be inhibited from being irradiated with unnecessary X-rays.

One specific example of how the voltage application instructing unit 8 determines that the number of rotations of the rotating anode 1 has fully increased is as follows. The voltage application instructing unit 8 determines that the rotating anode 1 has reached the number of rotations causing no damage when the period N or delay time D has elapsed from a start of rotation of the rotating anode 1 in a stopped state. The number of rotations of the rotating anode 1 can be said to have fully increased upon lapse of the period N or delay time D. Therefore, the rotating anode 1 will never be damaged even if a predetermined voltage is applied to the two electrodes 1 and 4.

The rotating anode 1 continues rotating for a while after the emission of X-rays is terminated and the brake is applied. When the number of rotations of the rotating anode 1 is maintained high enough in this state, the voltage can be applied to the two electrodes 1 and 4 immediately without waiting for the delay time D from the start of rotation. In the above construction, the number of rotations of the rotating anode 1 is high enough to cause no damage when the time from a point of time a previous application of the voltage to the two electrodes 1 and 4 is terminated until a point of time instructions for starting emission of X-rays are inputted to the input device is shorter than the predetermined allowed time AT. In this case, therefore, the voltage application instructing unit 8 in the above construction determines that the number of rotations causing no damage to the rotating anode 1 has been reached even before lapse of the delay time D from the start of rotation of the rotating anode 1. This improves the response of the X-ray source to an input made by the operator.

According to the construction in Embodiment 1, the X-ray tube 10 can be provided which can cope, with increased freedom, with changes made in the method of examination, for example. That is, since the operator can change the set voltage value Va at will, it is certain that the voltage applied to the rotating anode 1 is, from a point of time of application, what is desired by the operator.

Embodiment 2

Next, a radioscopic apparatus with the X-ray tube 10 described in Embodiment 1 will be described. The X-rays in the construction of Embodiment 2 are an example of the radiation in this disclosure.

Figure 6:
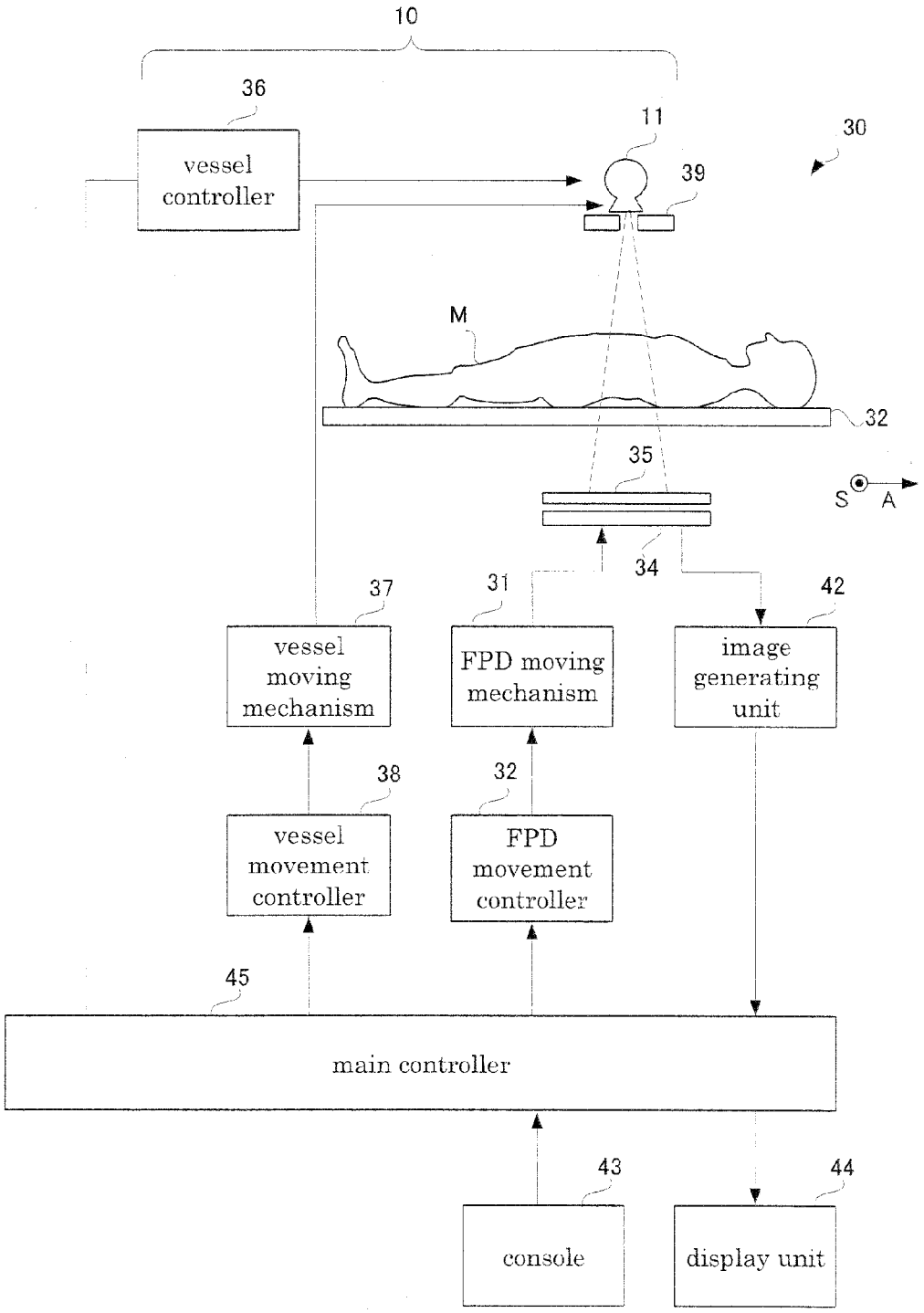
FIG. 6 is a functional block diagram illustrating a construction of an X-ray tube according to Embodiment 2.
Figure 7:
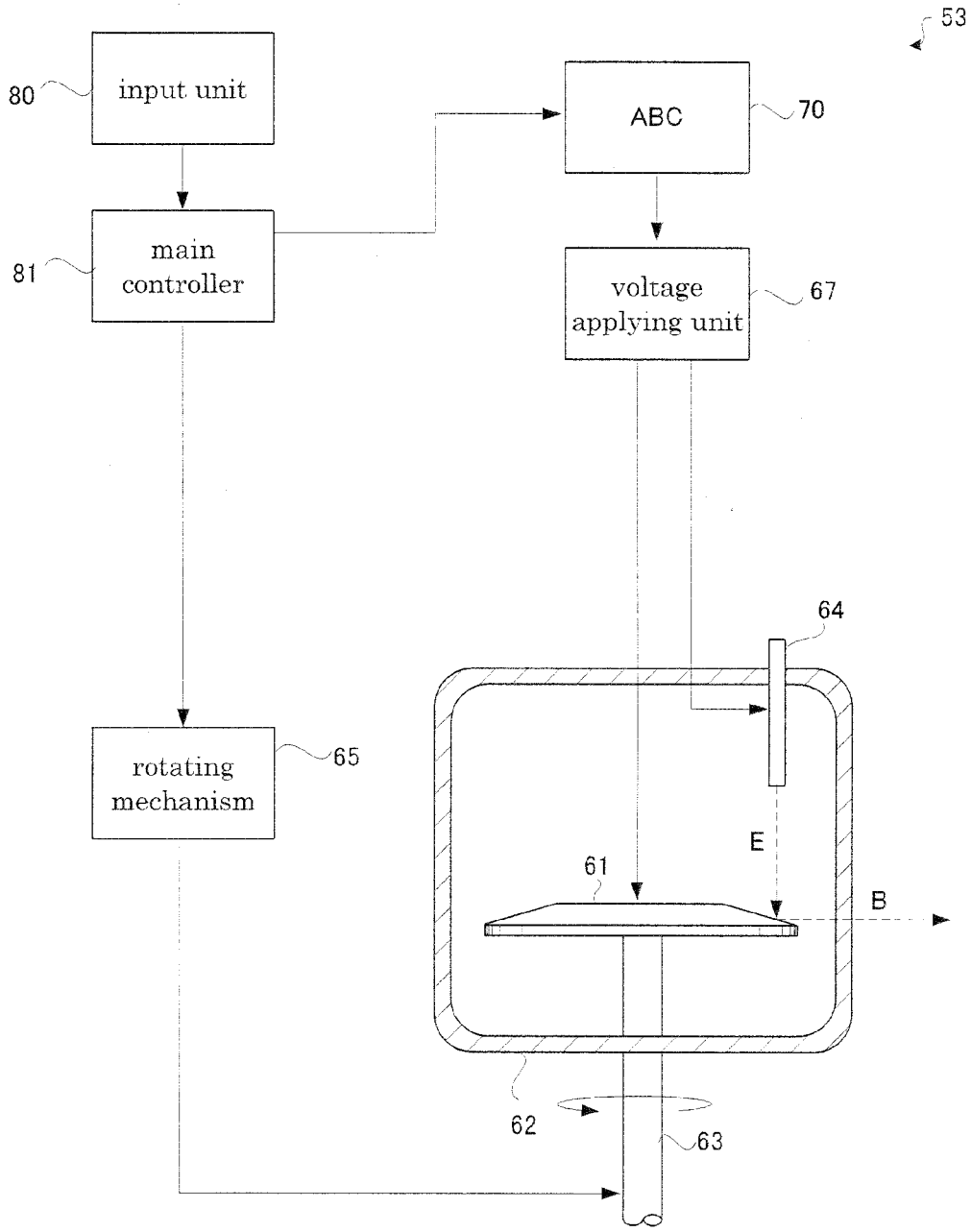
FIG. 7 is a functional block diagram illustrating the construction of the X-ray tube according to Embodiment 2.
Figure 8:
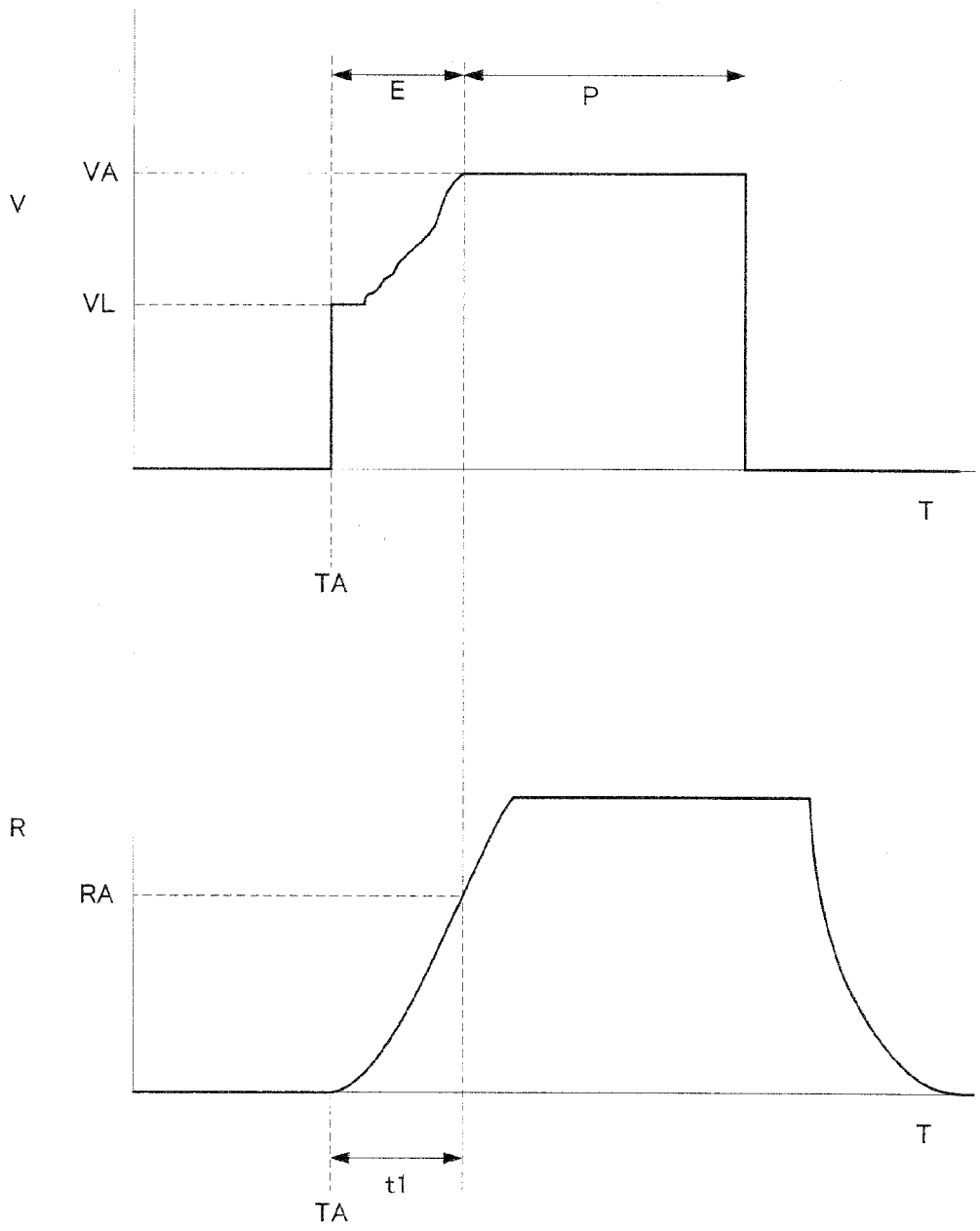
FIG. 8 is a timing chart illustrating a construction of a radiation source according to Embodiment 2.

First, a construction of an X-ray fluoroscopic apparatus 30 according to Embodiment 2 will be described. FIG. 6 is a functional block diagram illustrating the construction of the X-ray apparatus according to Embodiment 2. As shown in FIG. 6, the X-ray fluoroscopic apparatus 30 according to Embodiment 2 includes a top board 32 for supporting a patient M, the X-ray tube 10 disposed above the top board 32 for emitting an X-ray beam in pulse form, a collimator 39 for collimating the X-ray beam emitted from the X-ray tube 10, a flat panel detector (FPD) 34 for detecting X-rays transmitted through the patient M, and an X-ray grid 35 for removing scattered X-rays incident on the FPD 34. The construction in Embodiment 2 includes also a vessel controller 36 for controlling temporal pulse widths of the tube voltage, tube current and X-ray beam of the X-ray tube 10, a vessel moving mechanism 37 for moving the X-ray tube 10, and a vessel movement controller 38 for controlling this. The X-ray fluoroscopic apparatus 30 according to Embodiment 2 includes also an FPD moving mechanism 31 for moving the FPD 34, and an FPD movement controller 32 for controlling this.

The X-ray fluoroscopic apparatus 30 includes an image generating unit 42 for generating X-ray fluoroscopic images based on detection data outputted from the FPD 34. The X-ray tube corresponds to the radiation source in this invention. The FPD corresponds to the radiation detecting device in this disclosure.

The X-ray fluoroscopic apparatus 30 includes also a console 43 for receives instructions of the operator, and a display unit 44 for displaying X-ray fluoroscopic images or dynamic images.

The X-ray fluoroscopic apparatus 30 further includes a main controller 45 for carrying out overall control of the vessel controller 36, vessel movement controller 38 and image generating unit 42. This main controller 45 is constructed of a CPU and realizes the components by executing various programs. The above components may be realized as divided into arithmetic units in charge thereof. The main controller 29 in Embodiment 1 is integrated into the main controller 45 in this Embodiment 2.

Operation of the X-ray fluoroscopic apparatus 30 having such construction will be described. First, the patient M is placed on the top board 32. The operator controls the X-ray tube 10 through the vessel controller 36 to emit X-rays toward the patient M. X-rays transmitted through the patient M are detected by the FPD 34, and detection data is outputted to the image generating unit 42, which generates X-ray fluoroscopic images showing fluoroscopic images of the patient M. These X-ray fluoroscopic images are displayed on the display unit 44 to complete acquisition of X-ray fluoroscopic images by the X-ray fluoroscopic apparatus 30 according to Embodiment 2.

The X-ray fluoroscopic apparatus 30 according to Embodiment 2 emits X-rays in a way to inhibit X-ray exposure of the patient M. That is, X-rays of the intensity desired by the operator are emitted toward the patient M immediately upon start of X-ray emission. Therefore, unlike the prior art, there is no need to wait immediately after X-ray emission until X-ray intensity becomes an intensity suitable for diagnosis, whereby the patient M can be inhibited from being irradiated with unnecessary radiation.

This disclosure is not limited to the foregoing constructions, but may be modified as follows:

(1) In each of the foregoing embodiments, actual measurement may be carried out of the number of rotations of the rotating anode 1; and based on this the voltage application instructing unit 8 may give instructions to the voltage applying unit 7. The number of rotations measuring unit 9 (see to FIG. 1) measures the current number of rotations of the rotating anode 1 from time to time. The voltage application instructing unit 8 may wait until a point of time when the number of rotations is determined to have fully increased to such an extent that the rotating anode 1 is not damaged (may wait until a point of time when the number of rotations of the rotating anode 1 has reached an allowable number of rotations), and give instructions for voltage application to the voltage applying unit 7 from this point of time. That is, in this modification, the voltage application instructing unit 8 has two modes, which are a delay time standby mode for instructing voltage application after waiting for lapse of the period N or delay time D, and a number of rotations attainment standby mode for instructing voltage application after waiting for the number of rotations of the rotating anode 1 to increase fully. Which mode should be given priority can be selected freely. That is, when priority is given to the number of rotations attainment standby mode, voltage is applied even before lapse of the period N or delay time D, depending on the number of rotations of the rotating anode 1. When priority is given to the delay time standby mode, voltage is applied regardless of the number of rotations of the rotating anode 1, as long as the period N or delay time D elapses. The allowable number of rotations is stored in the allowable value storage unit 24. The number of rotations r noted hereinbefore can be used as an actual value of the allowable number of rotations. In this way, the voltage application instructing unit 8 according to this modification has a construction to instruct voltage application based on the number of rotations measured by the number of rotations measuring unit 9.

In the above modification, the voltage application instructing unit 8 determines that the number of rotations causing no damage to the rotating anode 1 has been reached when the number of rotations of the rotating anode 1 actually measured by the number of rotations measuring unit 9 reaches or exceeds a predetermined number of rotations. The number of rotations of the rotating anode 1 can be said to have fully increased if the number of rotations has reached or exceeded the predetermined number of rotations (allowable number of rotations). Therefore, the rotating anode 1 will never be damaged even if a predetermined voltage is applied to the rotating anode 1.

(2) In each of the foregoing embodiments, the FPD has been described as an example of the radiation detection device. This disclosure is not limited to this. The radiation detection device may be an image intensifier which converts radiation into visible light for display.

(3) Each of the foregoing embodiments relates to medical apparatus, but this disclosure is applicable also to industrial and nuclear apparatus.

(4) The X-rays in each of the foregoing embodiments are an example of the radiation in this disclosure. Therefore, this disclosure can be adapted also to radiation other than X-rays.

INDUSTRIAL UTILITY

As described above, this invention is suitable for medical radioscopic apparatus.

The invention claimed is:

1. A high-voltage apparatus for supplying voltage to a radiation source having a rotating anode, a chamber enclosing the rotating anode, a rotating device for rotating the rotating anode such that a number of rotations of the rotating anode increases to a target value, and a rotation control device for controlling the rotating, anode, the high-voltage apparatus comprising:

a voltage applying device for applying a voltage to the rotating anode; and a voltage application instructing device for instructing the voltage applying device to apply a predetermined voltage for enabling radioscopy after the rotation control device starts rotation of the rotating anode;

wherein the voltage application instructing device instructs the voltage applying device to apply the predetermined voltage to start irradiation at a time point when the rotating anode reaches a high number of rotations to an extent of being free from damage, said time point being before the number of rotations arrives at the target value.

2. The high-voltage apparatus according to claim 1, wherein:

the voltage application instructing device instructs application of the voltage at a point of time when the rotating anode reaches the high number of rotations to the extent of being free from damage by the application of the voltage; and the voltage application instructing device, based on a current and the voltage applied to the rotating anode, determines a period from a start of the rotation of the rotating anode until the rotating anode reaches the high number of rotations to the extent of being free from damage by the application of the voltage.

3. The high-voltage apparatus according to claim 1, wherein:

the voltage application instructing device instructs application of the voltage at a point of time of a lapsed delay time indicating a period between a point of time the application of the voltage to the rotating, anode is ended and the rotating anode reaches the high number of rotations to the extent of being free from damage by the application of the voltage; and the voltage application instructing device determines the delay time, based on a current and the voltage applied to the rotating anode, and a lag time between when the application of the voltage to the rotating, anode is ended and braking of the rotation of the rotating anode is started.

4. The high-voltage apparatus according to claim 1, further comprising a number of rotations measuring device thr measuring the number of rotations of the rotating anode;

wherein the voltage application instructing device instructs application of the voltage at a point of time when the number of rotations measured reaches the high number of rotations to the extent of the rotating anode being free from damage by the application of the voltage.

5. The high-voltage apparatus according to claim 3, further comprising an input device for inputting instructions of an operator;

wherein the voltage application instructing device instructs application of the voltage after instructions are given by the operator to end a previous application of the voltage to the rotating anode, and under a state where the high number of rotations to the extent of the rotating anode being free from damage.

6. The high-voltage apparatus according to claim 1, further comprising, a set value storage device for storing a set value to be referred to by the voltage application instructing, device;

wherein the set value is changeable.

7. A radiation source comprising:

a rotating anode;

a chamber enclosing the rotating anode;

a rotating device for rotating the rotating anode such that a number of rotations of the rotating anode increases to a target value;

a rotation control device for controlling the rotating anode;

a voltage applying device for applying a voltage to the rotating anode; and a voltage application instructing device for instructing the voltage applying device to apply a predetermined voltage for enabling radioscopy after the rotation control device starts rotation of the rotating anode;

wherein the voltage application instructing device instructs the voltage applying device to apply the predetermined voltage to start irradiation at a time point when the rotating anode reaches a high number of rotations to at extent of being free from damage, said time point being before the number of rotations arrives at the target value.

8. A radioscopic apparatus having the radiation source according to claim 7, comprising a radiation detecting device for detecting radiation emitted from the radiation source.

* * * * *